US008818219B2

(12) United States Patent
Mitamura

(10) Patent No.: US 8,818,219 B2
(45) Date of Patent: Aug. 26, 2014

(54) IMAGE FORMING APPARATUS AND TONER CHARGE AMOUNT ADJUSTMENT METHOD OF THE IMAGE FORMING APPARATUS

(75) Inventor: Hiromichi Mitamura, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 482 days.

(21) Appl. No.: 13/170,251

(22) Filed: Jun. 28, 2011

(65) Prior Publication Data

US 2012/0008969 A1 Jan. 12, 2012

Related U.S. Application Data

(60) Provisional application No. 61/362,435, filed on Jul. 8, 2010.

(51) Int. Cl.
*G03G 15/06* (2006.01)

(52) U.S. Cl.
USPC ..... 399/53; 399/29; 399/59; 399/254; 399/267; 399/277

(58) Field of Classification Search
USPC ..... 399/29, 30, 53, 55–59, 252–254, 399/265–267, 276, 277, 282
See application file for complete search history.

(56) References Cited

U.S. PATENT DOCUMENTS

| | | | | |
|---|---|---|---|---|
| 2008/0298844 | A1* | 12/2008 | Katoh et al. | 399/254 |
| 2009/0129796 | A1* | 5/2009 | Ochiai | 399/43 |
| 2010/0098447 | A1* | 4/2010 | Ootsuka | 399/53 |
| 2011/0052221 | A1* | 3/2011 | Hirobe et al. | 399/27 |
| 2012/0170949 | A1 | 7/2012 | Takeda | |

* cited by examiner

*Primary Examiner* — Walter L Lindsay, Jr.
*Assistant Examiner* — Jessica L Eley
(74) *Attorney, Agent, or Firm* — Amin, Turocy & Watson, LLP

(57) ABSTRACT

An image forming apparatus includes a developer containing part, a developer mixer, a mixer drive motor, a magnetic sleeve, a sleeve drive motor, a mixer rotation speed determination part and a motor drive controller. The developer containing part contains a two-component developer including a toner and a carrier. The developer mixer is provided in the developer containing part, agitates the two-component developer, and charges the toner and the carrier. The mixer rotation speed determination part determines the mixer rotation speed of the mixer drive motor according to a supply amount of the toner supplied to the developer containing part from a toner cartridge by driving of a toner supply motor. The motor drive controller independently performs rotation control of the sleeve drive motor and the mixer drive motor, and rotates and controls the mixer drive motor at the mixer rotation speed determined by the mixer rotation speed determination part.

18 Claims, 11 Drawing Sheets

FIG.7

| PRINTING RATIO | MIXER ROTATION SPEED (rpm) |
|---|---|
| 0%～10% | 250 |
| 10%～20% | 300 |
| 20%～30% | 350 |
| ... | ... |
| 80%～90% | 650 |
| 90%～100% | 700 |

FIG.10

| TONER SUPPLY MOTOR DRIVE TIME (ms) | MIXER ROTATION SPEED (rpm) |
|---|---|
| 100 | 250 |
| 150 | 300 |
| 200 | 350 |
| ... | ... |
| 400 | 550 |
| 450 | 600 |
| ... | ... |

IMAGE FORMING APPARATUS AND TONER CHARGE AMOUNT ADJUSTMENT METHOD OF THE IMAGE FORMING APPARATUS

CROSS-REFERENCE TO RELATED APPLICATIONS

This application is based upon and claims the benefit of priority from Provisional U.S. Application No. 61/362,435, filed on 8 Jul. 2010, the entire contents of which are incorporated herein by reference.

FIELD

Embodiments described herein relate generally to an image forming apparatus and a toner charge amount adjustment method of the image forming apparatus.

BACKGROUND

In an electrophotographic process, to keep a developer charge amount constant is very importance in order to keep high print quality. However, when images having a high printing ratio are continuously printed, a toner corresponding to the amount of toner consumed by development is supplied from a cartridge in order to keep toner density in the developer constant. At this time, since a large amount of toner is supplied, a chance of contact with carrier is reduced. Consequently, a sufficient toner charge amount is not obtained, and there arises a problem such as white background fogging or deterioration in gradation reproducibility due to excessive development.

On the other hand, there is an idea to increase the chance of contact between toner and carrier by raising the rotation speed of a developer mixer. However, when the rotation speed of the developer mixer is excessively increased, the deterioration of the toner progresses. Thus, the agitation of the developer is required to be performed at a minimum necessary mixer rotation intensity and in a short time.

BRIEF DESCRIPTION OF THE DRAWINGS

FIG. 7 is a view showing a specific example of information defining a relation between a printing ratio and a mixer rotation speed;

FIG. 10 is a view showing a specific example of information defining a relation between a toner supply motor drive time and a mixer rotation speed.

DETAILED DESCRIPTION

In general, according to one embodiment, an image forming apparatus includes a developer containing part, a developer mixer, a mixer drive motor, a magnetic sleeve, a sleeve drive motor, a mixer rotation speed determination part and a motor drive controller.

The developer containing part contains a two-component developer including a toner and a carrier. The developer mixer is provided in the developer containing part, agitates the two-component developer, and charges the toner and the carrier. The mixer drive motor drives the developer mixer.

The magnetic sleeve is provided in the developer containing part, and supplies the charged toner to an oppositely arranged photoreceptor. The sleeve drive motor drives the magnetic sleeve. The mixer rotation speed determination part determines the mixer rotation speed of the mixer drive motor according to a supply amount of the toner supplied to the developer containing part from a toner cartridge by driving of a toner supply motor. The motor drive controller independently performs rotation control of the sleeve drive motor and the mixer drive motor, and rotates and controls the mixer drive motor at the mixer rotation speed determined by the mixer rotation speed determination part.

FIRST EMBODIMENT

Figure 1:
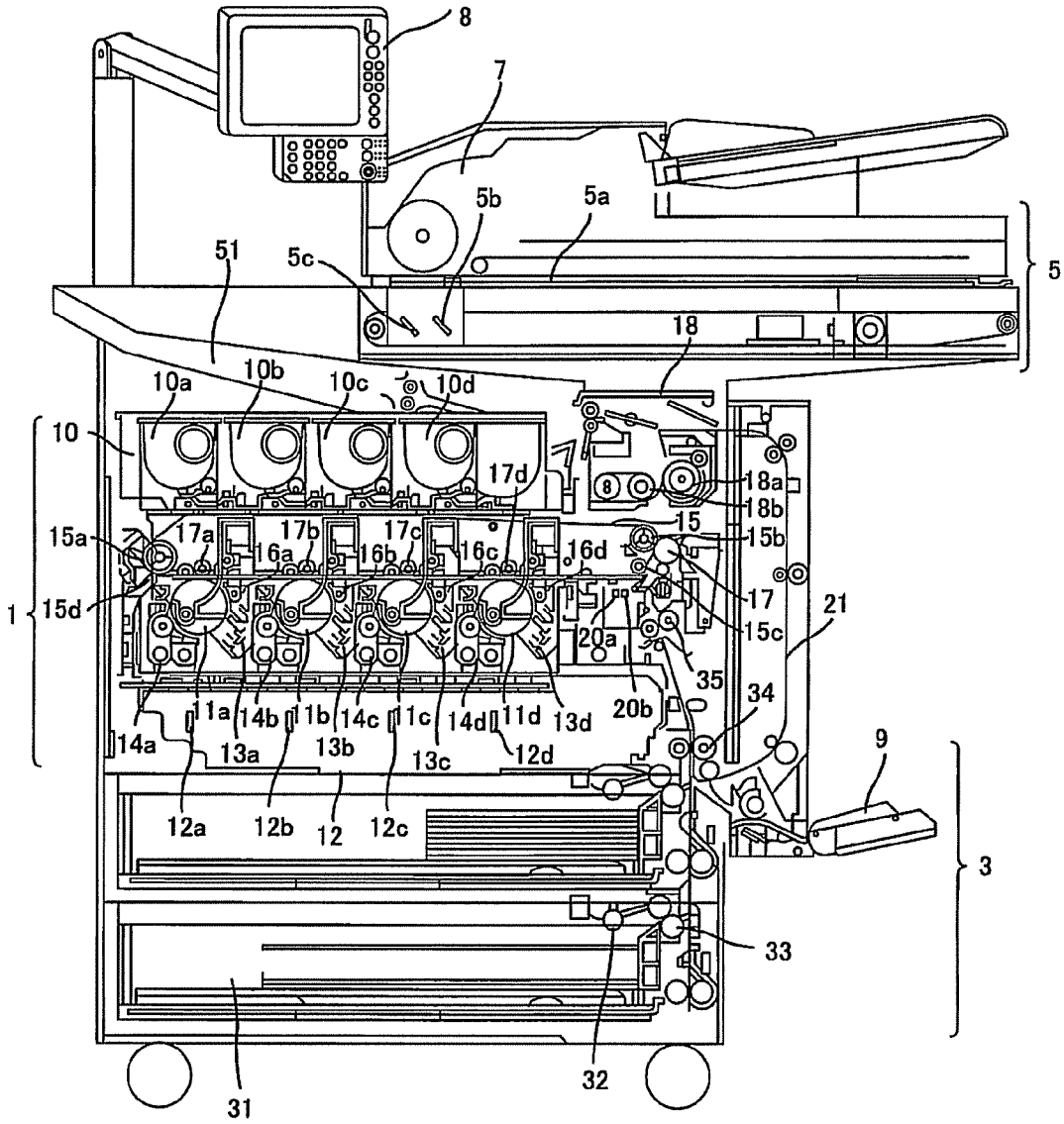
FIG. 1 is a schematic structural view showing an image forming apparatus of a first embodiment.

FIG. 1 is a sectional view of an image forming apparatus 100 of a first embodiment. The image forming apparatus 100 is a four-tandem color copier. The image forming apparatus 100 includes an image forming part 1 to output image information as an output image called a hard copy or print out, a sheet supply part 3 to supply a sheet (output medium) of an arbitrary size used for the image output to the image forming part 1, and a scanner (image reading part) 5 to capture, as image data, the image information as an object of image formation in the image forming part 1 from a physical object (hereinafter referred to as a document). The image reading part 5 includes a transparent platen glass 5*a* on which the document is placed, a light source 5*b* to irradiate the document, and a reflecting mirror 5*c* to reflect light reflected from the document.

An auto document feeder (ADF) 7 is provided at an upper side of the image forming apparatus 100. When the document is sheet-like, after the reading of the image information in the image reading part 5 is ended, the auto document feeder 7 discharges the document subjected to the reading to a discharge position from a read position, and guides a next document to the read position. Besides, the image forming apparatus 100 is provided with an instruction input part for instructing start of image formation in the image forming part 1 and start of reading the image information of the document by the image reading part 5, that is, a display part 8, as a control panel.

Next, a structure of the image forming part 1 will be described. Toner cartridges 10*a* to 10*d* are provided at the upper side of the image forming part 1. The toner cartridges 10*a* to 10*d* are detachable from and attachable to a toner cartridge holding mechanism 10 provided at the front side of the image forming part 1. The toner cartridges 10*a* to 10*d* respectively contain toners of yellow (Y), magenta (M), cyan (C) and black (K), and sequentially supply the toners to after-mentioned developing devices 14*a* to 14*d*.

The image forming part 1 includes photoconductive drums 11*a* to 11*d* as image carriers to carry latent images, an exposure device 12 that includes LEDs 12*a* to 12*d* and forms the latent images by irradiating laser beams modulated according to writing image data to the photoconductive drums 11*a* to 11*d*, charging devices 13*a* to 13*d* to uniformly charge the photoconductive drums 11*a* to 11*d*, the developing devices 14*a* to 14*d* to develop the latent images formed on the photoconductive drums 11*a* to 11*d*, an intermediate transfer belt 15 to hold developer images developed on the photoconductive drums 11*a* to 11*d* in a stacked state, and cleaners 16*a* to 16*d* to remove adhered substances such as residual toner on the photoconductive drums 11*a* to 11*d*.

Further, the image forming part 1 includes a transfer device 17 to transfer the developer images stacked on the intermediate transfer belt 15 to a sheet-like output medium such as standard paper which is not subjected to special processing or an OHP sheet as a transparent resin sheet, and a fixing device 18 to fix the developer images transferred on the intermediate transfer belt 15 to the output medium.

The intermediate transfer belt 15 is stretched by a drive roller 15*a* to rotate the intermediate transfer belt 15, a backup roller 15*b* for secondary transfer, and a tension roller 15*c* to cause tensile force applied to the intermediate transfer belt 15 to be constant. Besides, a belt cleaner 15*d* is arranged to contact the intermediate transfer belt 15 at a position opposite to the drive roller 15*a* across the intermediate transfer belt 15.

Primary transfer rollers 17*a* to 17*d* are arranged to come in press contact with the photoconductive drums 11*a* to 11*d* through the intermediate transfer belt 15 on the rear side of the intermediate transfer belt 15*a* and at places (hereinafter referred to as "primary transfer parts") where the intermediate transfer belt 15 contacts the photoconductive drums 11*a* to 11*d*.

The transfer device 17 (hereinafter referred to as a "secondary transfer part") is opposite to the backup roller 15*b* arranged on the rear side (inner side) of the intermediate transfer belt 15, and is arranged to contact the intermediate transfer belt 15 at the toner carrying surface side (outer side) of the intermediate transfer belt 15.

The respective photoconductive drums 11*a* to 11*d* hold electrostatic latent images (toner images) of colors to be visualized (developed) by the developing devices 14*a* to 14*d* containing toners of arbitrary colors of yellow (Y), magenta (M), cyan (C) and black (K). The order of arrangement thereof is regulated in a specified order according to an image forming process and toner characteristics. The intermediate transfer belt 15 holds the toner images of the respective colors formed by the photoconductive drums 11*a* to 11*d* and the corresponding developing devices 14*a* to 14*d* in the order of formation.

Besides, in order to detect the reflected light amount of a toner pattern formed on the intermediate transfer belt 15, an LED light source 20*a* and an optical sensor 20*b* are arranged between the fourth station of the primary transfer part and the secondary transfer part.

When the transfer device 17 transfers the developer image, the sheet supply part 3 supplies an output medium at a specified timing to the transfer device 17. Cassettes set in plural cassette slots 31 contain output media of arbitrary sizes. A pickup roller 32 takes out an output medium according to the operation of image formation. The size of the output medium corresponds to the size of the developer image formed by the image forming part 1. A separation mechanism 33 prevents two or more output media from being taken out from the cassette by the pickup roller 32. Plural conveyance rollers 34 convey the one output medium separated by the separation mechanism 33 to an aligning roller 35. The aligning roller 35 sends the output medium to the transfer position where the transfer device 17 contacts the intermediate transfer belt 15 in synchronization with the timing when the transfer device 17 transfers the developer image from the intermediate transfer belt 15. Incidentally, plural cassette slots 31, plural pickup rollers 32 and plural separation mechanisms 33 may be prepared when necessary, and the cassette can be arbitrarily mounted to a different slot.

The output medium on which the image information is fixed through the fixing device 18 is discharged to a discharge tray 51 provided at a lateral side of the image reading part 5 and above the image forming part 1. Here, the fixing device 18 includes a fixing roller 18*a* and a pressure roller 18*b* at the downstream side in the paper discharge direction. The output medium on which the developer image (toner image) is transferred is heated and pressed by the fixing roller 18*a* heated up to, for example, 180° C. and the pressure roller 18*b*, so that the toner image is melted and the image information is fixed.

Besides, the image forming apparatus 100 includes a side paper discharge tray 9 on a lateral side of the image forming part 1. The output medium discharged from the fixing device 18 is guided to the side paper discharge tray 9 through a relay conveyance part 21.

Figure 2:
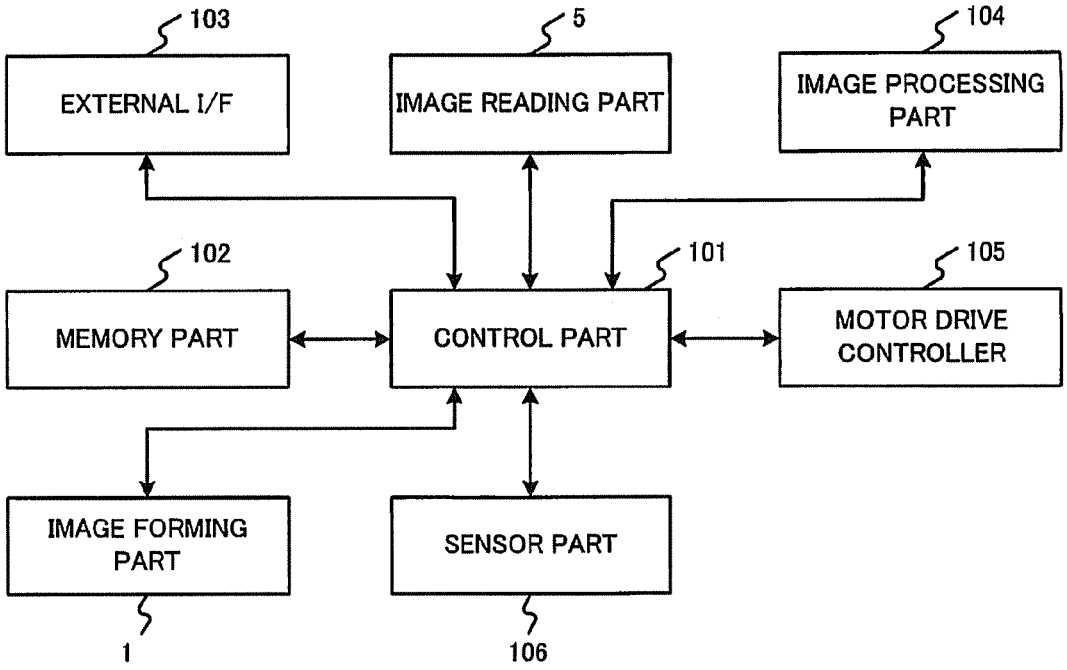
FIG. 2 is a block diagram showing an example of the whole structure of the image forming apparatus.

FIG. 2 is a block diagram showing an example of the whole structure of the image forming apparatus 100. Here, the image forming apparatus 100 includes a control part 101, a memory part 102, an external I/F part 103, an image processing part 104, a motor drive controller, 105 and a sensor part 106 in addition to the image forming part 1 and the image reading part 5.

The control part 101 is a control device to control the operations of the respective parts constituting the image forming apparatus 100. As the control part 101, a CPU (Central Processing Unit), an MPU (Micro Processing Unit) capable of executing an arithmetic operation comparable to the CPU, or the like can be used.

The memory part 102 is a storage device to store programs for executing the respective processes in the image forming apparatus 100, definition data, detection values of various sensors, and the like. The memory part 102 includes, for example, a RAM (Random Access Memory), a ROM (Read Only Memory), a DRAM (Dynamic Random Access Memory), an SRAM (Static Random Access Memory), a VRAM (Video RAM), a flash memory or the like.

The external I/F part 103 mediates information transmission between an equipment, such as a personal computer, connected to a network (not shown) and the image forming apparatus 100.

The image processing part 104 converts the output signal from the reflected light received by a CCD in the image reading part 5 into image data of yellow (Y), magenta (M), cyan (C) and black (K), performs data processing such as density correction, and outputs the writing image data to the control part 101. Besides, the image processing part 104 performs data processing on data inputted from the PC through the external I/F 103, and outputs the writing image data to the control part 101.

The motor drive controller 105 controls driving of various motors in the image forming apparatus 100 based on control information from the control part 101. For example, supply voltage to the motor is changed to control the rotation speed of the motor. The sensor part 106 includes various sensors installed in the image forming apparatus 100, such as a temperature sensor and a humidity sensor.

Figure 3:
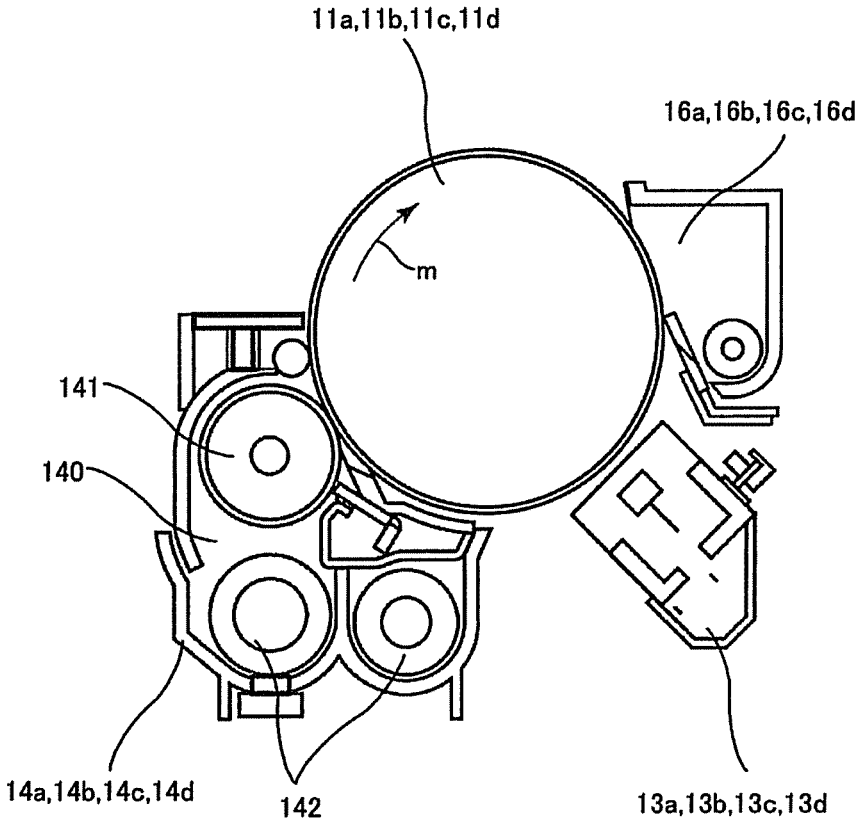
FIG. 3 is a sectional view of an image forming part.

FIG. 3 is a sectional view of the image forming part 1. In FIG. 3, the developing devices 14*a* to 14*d* are respectively opposite to the LEDs 12*a* to 12*d* arranged below the photoconductive drums 11*a* to 11*d*, and are provided around the photoconductive drums 11*a* to 11*d* and downstream thereof in the rotation direction indicated by an arrow m.

Besides, each of the developing devices 14*a* to 14*d* includes a developer containing part 140 to contain a two-component developer including a toner and a carrier, a magnetic sleeve 141 arranged to be opposite to the photoconductive drum 11*a* to 11*d*, and a developer mixer 142 to agitate and convey the developer to the magnetic sleeve 141 side.

The magnetic sleeve 141 is made of a magnetic substance, attracts both the carrier and the toner in the developer, and supplies the toner to the photoconductive drum 11*a* to 11*d* side. The developer mixer 142 includes a helical fin in the inside, and the fin rotates to agitate the developer.

Figure 4:
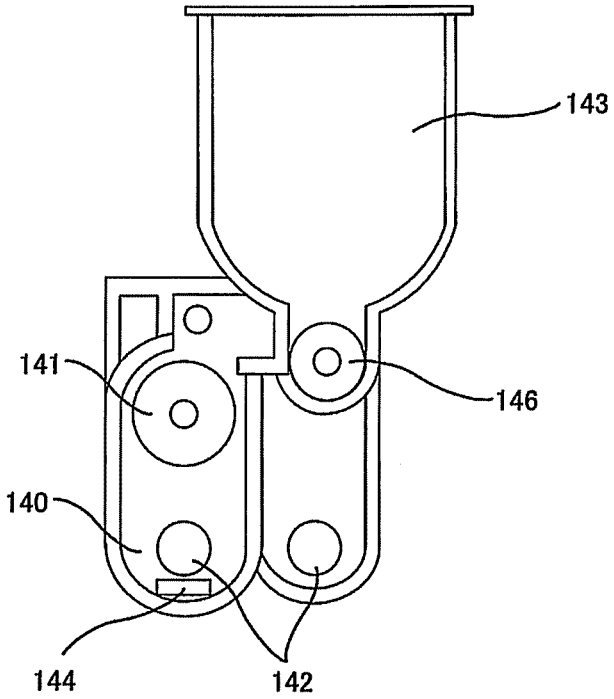
FIG. 4 is a sectional view of a developing device.

FIG. 4 is a sectional view of the developing device 14*a* to 14*d*. In FIG. 4, the developing device 14*a* to 14*d* includes a toner hopper 143 to store the toner and to supply the toner to the developer mixer 142, and a toner density sensor 144 provided at the bottom of the developer containing part 140 to detect the toner density.

When it is detected based on the output of the toner density sensor 144 that the toner in the developer containing part 140 of the developing device 14*a* to 14*d* becomes low, the toner is supplied from the corresponding toner cartridge 10*a* to 10*d* to the developing device 14*a* to 14*d* for a specified time. Specifically, the toner is supplied from the toner cartridge 10*a* to 10*d* to the toner hopper 143, and a toner supply motor 145 drives a supply roller 146, so that the toner is supplied from the toner hopper 143 into the developer containing part 140.

After the supply, the rotation of the magnetic sleeve 141 is stopped, and only the developer mixer 142 is rotated. When it is detected that the output of the toner density sensor 144 exceeds a specific threshold, the toner supply is completed.

Figure 5:
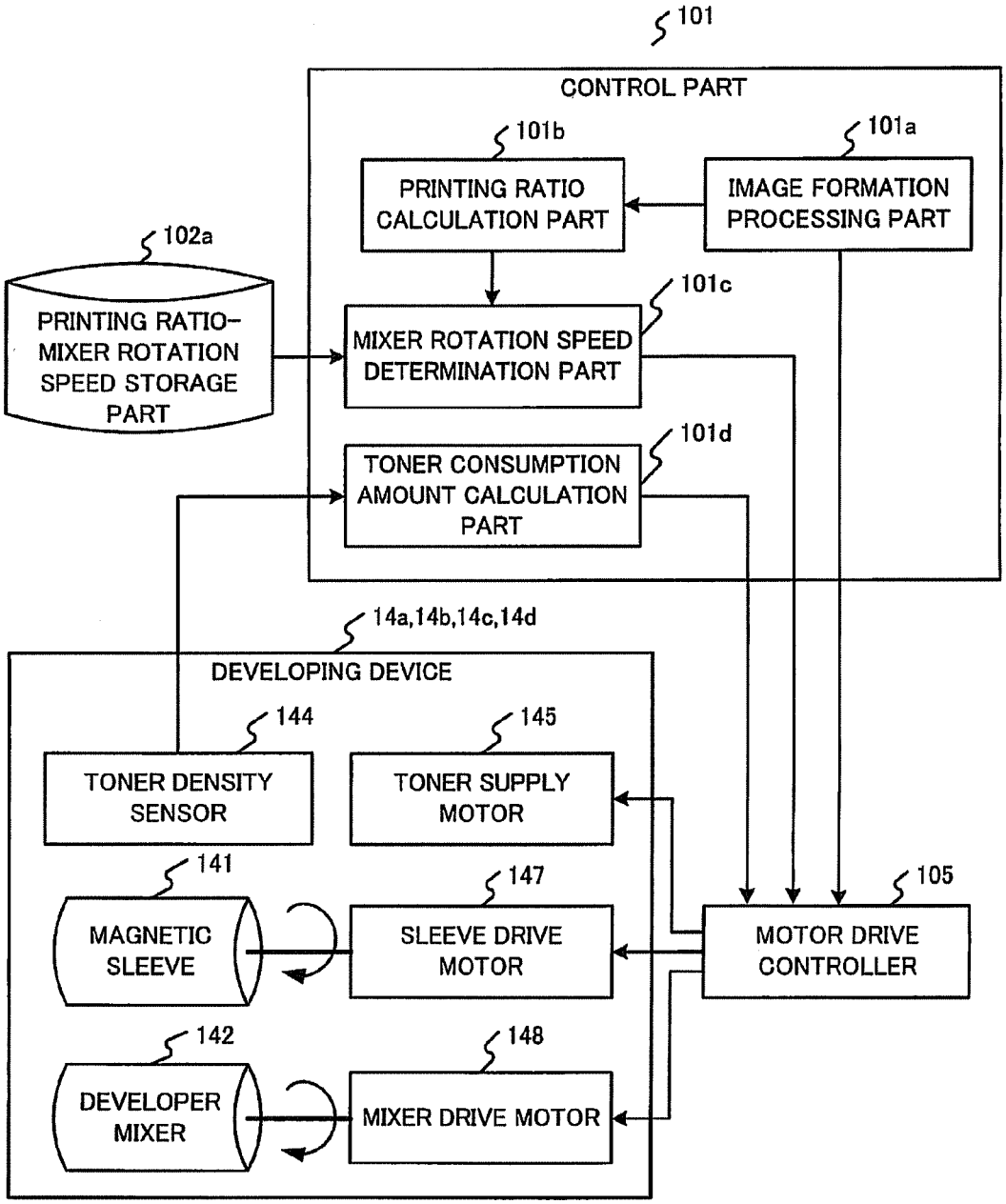
FIG. 5 is a block diagram for explaining control of the developing device in the image forming apparatus.

FIG. 5 is a block diagram for explaining the control of the developing device 14*a* to 14*d* in the image forming apparatus 100. In FIG. 5, the developing device 14*a* to 14*d* further includes a sleeve drive motor 147 to rotate and drive the magnetic sleeve 141, and a mixer drive motor 148 to rotate and drive the developer mixer 142.

The motor drive controller 105 is the controller to independently control the toner supply motor 145, the sleeve drive motor 147 and the mixer drive motor 148 based on control information from the control part 101. For example, at the time of initial adjustment, the mixer drive motor 148 is driven while the sleeve drive motor 147 is stopped. Here, the initial adjustment is the adjustment in which toner supply is performed from the toner cartridge 10*a* to 10*d* to the developer containing part 140 of the developing device 14*a* to 14*d* until the toner density sensor 144 detects that the toner density again reaches the specific toner density.

After the initial adjustment is ended, the motor drive controller 105 drives the sleeve drive motor 147 and the mixer drive motor 148 at the time of image formation and the time of toner supply. For example, the rotation speed of the sleeve drive motor 147 and the mixer drive motor 148 at the time of image formation is such that when the rotation speed of the sleeve drive motor 147 is 450 rpm, the rotation speed of the mixer drive motor 148 is about 600 rpm. When the mixer drive motor 148 is driven, the developer mixer 142 rotates at a specified rotation speed (hereinafter referred to as a "mixer rotation speed") in the developer containing part 140, and agitates the developer. By this agitation, the toner and the carrier contact each other and are charged.

Figure 6:
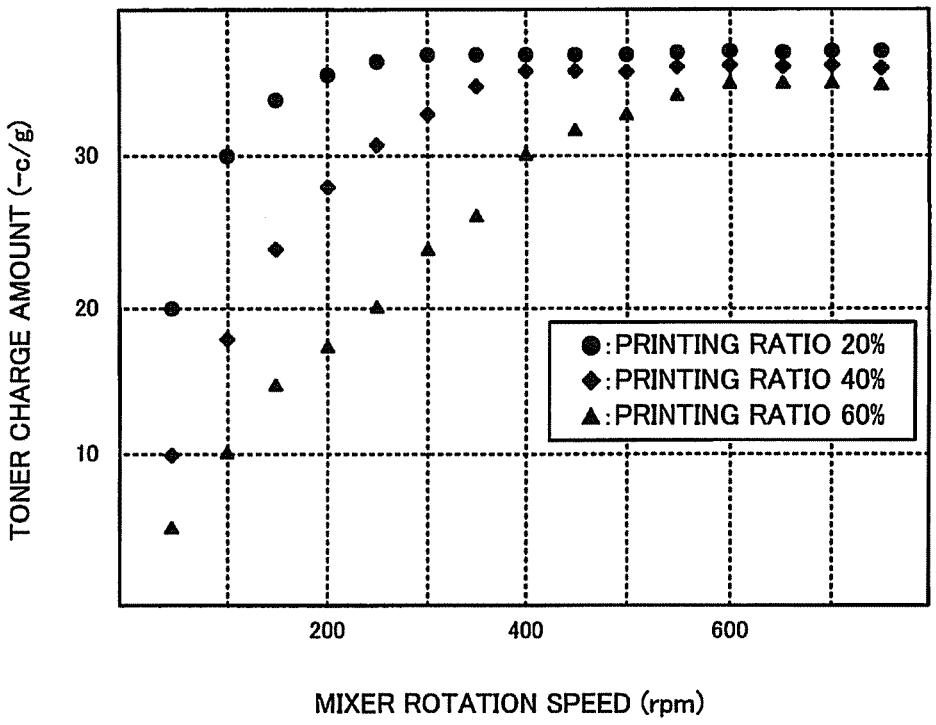
FIG. 6 is a view showing a relation between a toner charge amount and a mixer rotation speed.

The toner charge amount is changed according to the mixer rotation speed and the toner supply amount. FIG. 6 shows a relation between the toner charge amount and the mixer rotation speed in the cases where the printing ratio at the time of printing is 20%, 40% and 60%. As the printing ratio becomes high, the toner consumption amount becomes large, and the toner supply amount also becomes large. Thus, when reference is made to FIG. 6, it is understood that when the mixer rotation speed is low, as the printing ratio becomes high, it becomes difficult to obtain a sufficient toner charge amount. On the other hand, when the mixer rotation speed exceeds the specific level, the sufficient toner charge amount can be obtained in any printing ratio. However, the mixer rotation speed at which the sufficient charge amount is obtained varies according to the printing ratio. Then, in this embodiment, as shown in FIG. 7, a relation (hereinafter referred to as "printing ratio-mixer rotation speed correspondence information") between the printing ratio and the mixer rotation speed is previously defined in a printing ratio-mixer rotation speed storage part 102*a* (memory part 102). That is, the mixer rotation speed is defined by the ratio to the number of reference pixels (or reference printing ratio). Here, the printing ration-mixer rotation speed correspondence information is set such that as the printing ratio increases, the mixer rotation speed becomes high. For example, the mixer rotation speed at the printing ratio of 30% is made a reference, and in the case of a printing ratio of 45%, the mixer rotation speed is made 1.5 times larger, so that the rising characteristic of the toner charge amount is improved, and the sufficient charge amount is obtained.

Besides, in FIG. 5, the control part 101 includes an image formation processing part 101*a*, a printing ratio calculation part 10*b*, a mixer rotation speed determination part 101*c*, and a toner consumption amount calculation part 101*d*.

The image formation processing part 101*a* controls an equipment constituting the image forming part 1, and performs image forming process on the writing image data acquired from an equipment on the network or the image reading part 5.

The printing ratio calculation part 101*b* counts the number of pixels per unit number of printed sheet, calculates the printing ratio, and outputs the printing ratio to the mixer rotation speed determination part 101*c*. The printing ratio is an occupied ratio of a print area in a main scanning direction corresponding to a perpendicular direction to the movement direction of the intermediate transfer belt 15 in an area where an image can be formed. For example, the printing ratio can be calculated by analyzing the writing image data outputted by a computer to output image information or the image reading part. Specifically, the number of all pixels of the writing image data and the number of pixels to be printed (hereinafter referred to as "the number of print pixels") in the number of pixels within a previously determined range are counted, and the printing ratio is calculated by an expression: (printing ratio)=(the number of print pixels)/(the number of all pixels).

Besides, the printing ratio can be calculated by a method other than the method of previously analyzing the writing image data. For example, since the exposure time of the exposure device has a proportional relation with the number of print pixels, that is, the number of exposed dots, the printing ratio can be calculated by obtaining from the number of exposed dots corresponding to the actual exposure time of the exposure device based on the writing image data. Specifically, with respect to the number of exposed dots necessary for performing full-surface solid printing in the area of an A4 (297 mm×210 mm) sheet, when the ratio of the number of exposed dots on one A4 sheet at the time of measurement is obtained, the printing ratio can be calculated as follows:

the number of exposed dots at the time of *A4* solid printing=$(297/25.4\times600)\times(210/25.4\times600)=3.48\times10^7$ the actual number of exposed dots=$7.5\times10^5$ printing ratio=$(7.5\times10^5/3.48\times10^7)\times100\approx2.16(\%)$.

The mixer rotation speed determination part 101*c* determines the mixer rotation speed of the mixer drive motor to be a high value according to the increasing tendency of the toner supply amount from the toner cartridge 10*a* to 10*d* to the developer containing part 140. Specifically, reference is made to the printing ratio-mixer rotation speed correspondence information stored in the printing ratio-mixer rotation speed storage part 102*a* while using the printing ratio calculated by the printing ratio calculation part 101*b* as a key, and the mixer rotation speed of the mixer drive motor 148 is determined. The mixer rotation speed determination part 101*c* outputs the determined mixer rotation speed to the motor drive controller 105.

The toner consumption amount calculation part 101*d* calculates the toner consumption amount based on the density data outputted by the toner density sensor 144, determines the toner supply amount corresponding to the toner consumption amount, and outputs to the motor drive controller 105. The motor drive controller 105 controls the driving of the toner supply motor 145 according to the toner supply amount, and supplies the toner.

Figure 8:
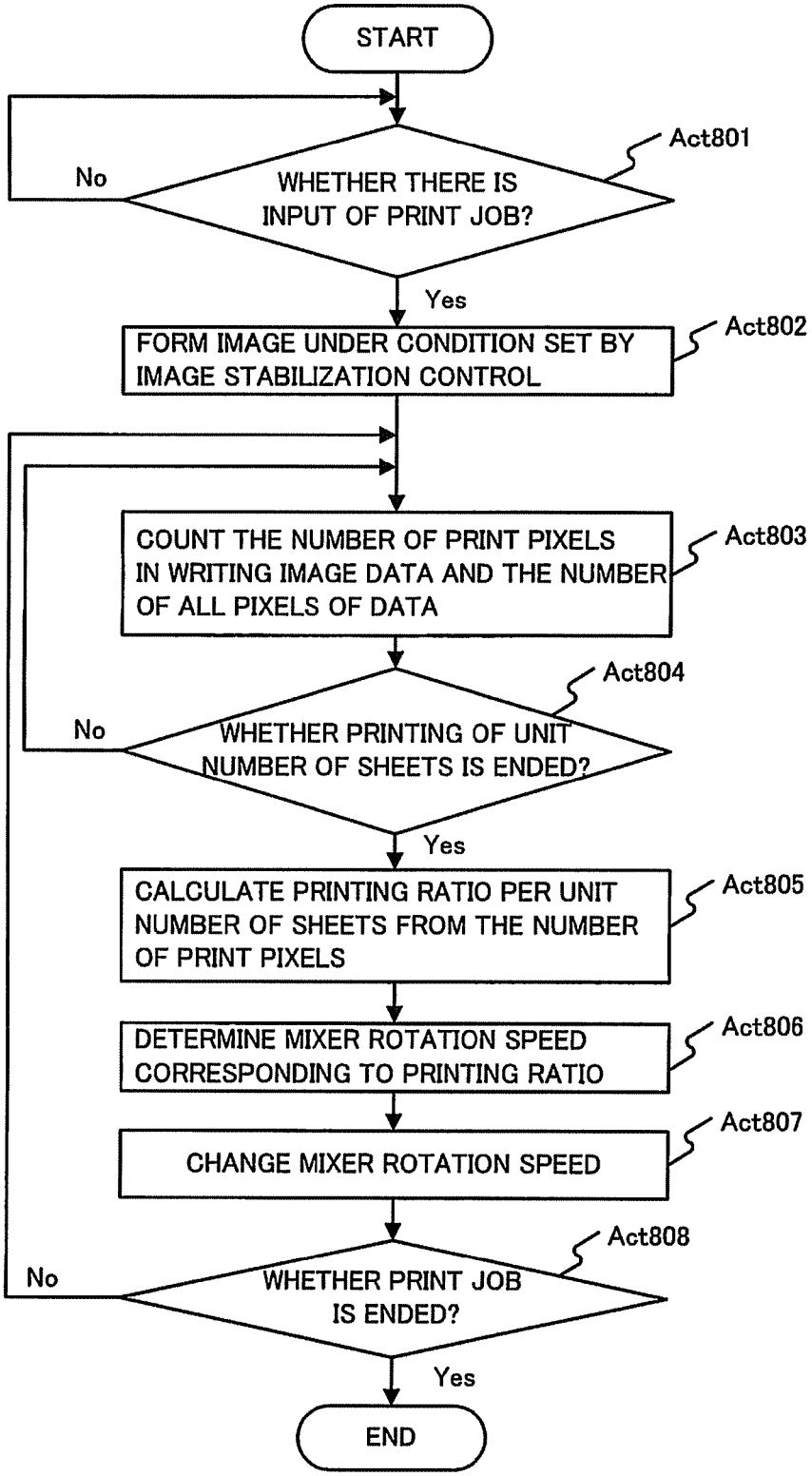
FIG. 8 is a flowchart showing a specific example of a control process of the developing device in the image forming apparatus.

FIG. 8 is a flowchart showing a specific example of the control process of the developing devices 14*a* to 14*d* in the image forming apparatus 100. Here, a description will be made on the assumption that image stabilization control is previously performed.

At Act 801, the image formation processing part 101*a* determines the presence or absence of input of a print job. Here, when determination is made that the print job is inputted (Act 801: Yes), advance is made to Act 802. When determination is made that the print job is not inputted (Act 801: No), a standby state occurs.

At Act 802, the image formation processing part 101*a* outputs an image forming condition, which is set in the finally executed image stabilization control and is stored in the memory part 102, to the image forming part 1 and causes the image forming process to be executed.

At Act 803, the printing ratio calculation part 101*b* analyzes the writing image data acquired from the image formation processing part 101*a*, and counts the number of print pixels and the number of all pixels of the data. Besides, the printing ratio calculation part 101*b* counts the number of printed sheets during the execution of the print job, and stores in the memory part 102.

At Act 804, the printing ratio calculation part 101*b* determines whether the number of printed sheets stored in the memory part 102 reaches the unit number of sheets. Here, when determination is made that printing of the unit number of sheets is ended (Act 804: Yes), advance is made to Act 805. When determination is made that printing of the unit number of sheets is not ended (Act 804: No), return is made to Act 803.

At Act 805, the printing ratio calculation part 101*b* calculates the printing ratio per unit number of sheets from the number of print pixels, and outputs to the mixer rotation speed determination part 101*c*.

At Act 806, the mixer rotation speed determination part 101*c* refers to the printing ratio-mixer rotation speed correspondence information stored in the printing ratio-mixer rotation speed storage part 102*a* while using the printing ratio calculated by the printing ratio calculation part 101*b* as a key. When determining the mixer rotation speed of the mixer drive motor 148, the mixer rotation speed determination part outputs a motor drive signal corresponding to the mixer rotation speed to the motor drive controller 105.

At Act 807, the motor drive controller 105 controls the supply voltage and the like to the mixer drive motor 148 based on the motor drive signal outputted from the mixer rotation speed determination part 101*c*, and the motor rotates at the determined mixer rotation speed.

At Act 808, the image formation processing part 101*a* determines whether the print job is ended. Here, when determination is made that the print job is ended (Act 808, Yes), the process is ended. When determination is made that the print job is not ended (Act 808: No), return is made to Act 803, and the process of Act 803 to Act 808 is repeated until the print job is ended.

As described above, according to the image forming apparatus 100 of the embodiment, even when the toner supply amount becomes large, for example, even when a continuous print job having a high printing ratio is executed, since the agitation can be performed at suitable mixer rotation intensity, a sufficient toner charge amount can be obtained. Thus, the occurrence of a problem such as white background fogging or deterioration in gradation reproducibility due to excessive development can be suppressed. Besides, since the agitation of the developer can be performed at the necessary minimum mixer rotation intensity, the deterioration of the toner can be suppressed.

SECOND EMBODIMENT

Hereinafter, a second embodiment will be described with reference to FIGS. 9 to 11. The second embodiment is different from the first embodiment only in a method of determining a mixer rotation speed. Since the others are the same as the first embodiment, the same components as those explained in the first embodiment are denoted by the same reference numerals and their detailed explanation is omitted.

Figure 9:
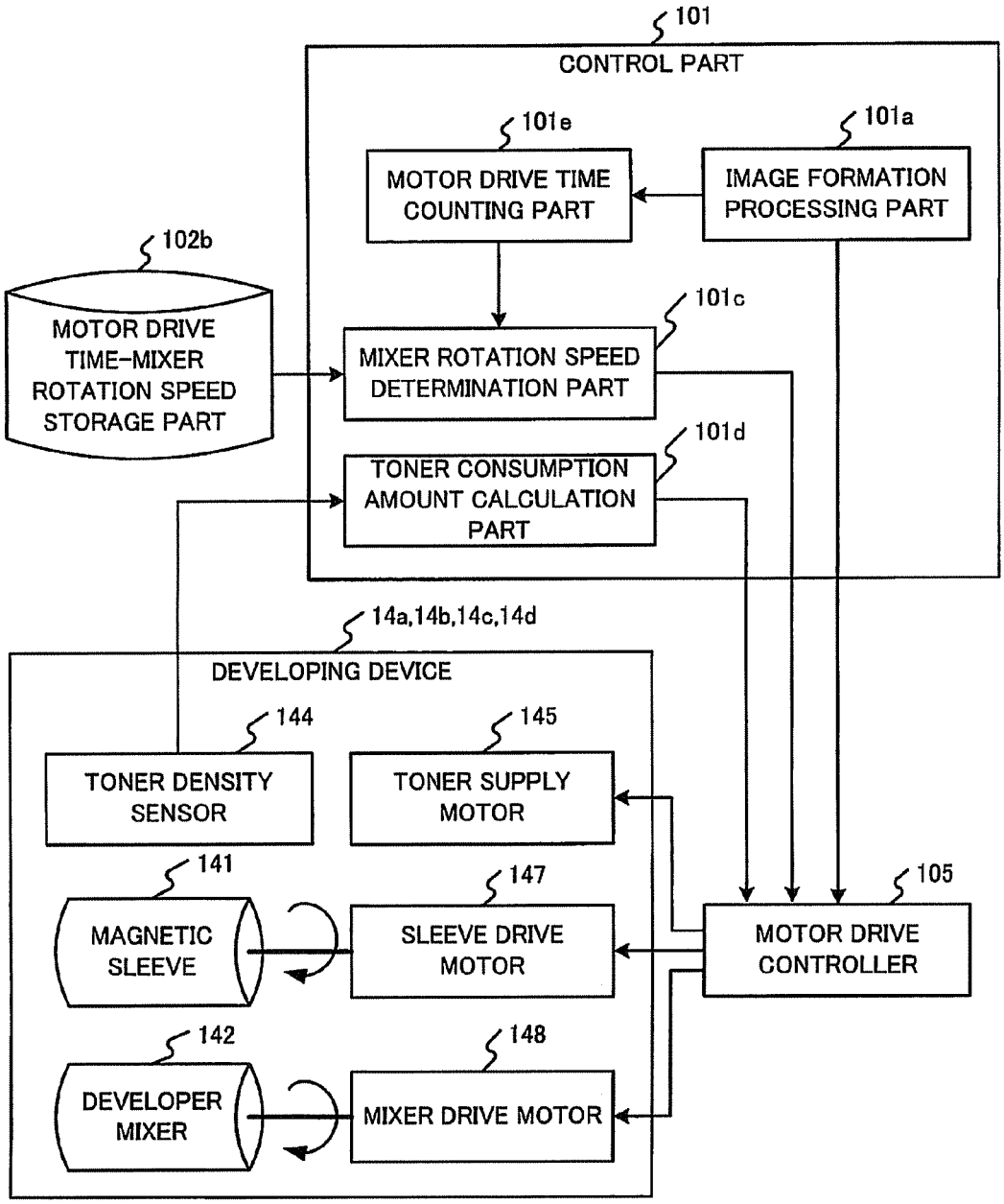
FIG. 9 is a block diagram for explaining control of a developing device in an image forming apparatus of a second embodiment.

FIG. 9 is a block diagram for explaining a motor drive control in an image forming apparatus 100 of the second embodiment. Here, differently from the image forming apparatus 100 shown in FIG. 5, the printing ratio calculation part 101*b* is replaced by a motor drive time counting part 101*e*, and the printing ratio-mixer rotation speed storage part 102*a* is replaced by a motor drive time-mixer rotation speed storage part 102*b*.

In this embodiment, a relation between a motor drive time and a mixer rotation speed (hereinafter referred to as "motor drive time-mixer rotation speed correspondence information") is previously defined in the motor drive time-mixer rotation speed storage part 102*b* (memory part 102). FIG. 10 is a view showing a specific example of information defining the relation between the toner supply motor drive time and the mixer rotation speed. Here, the motor drive time-mixer rotation speed correspondence information is such that as the motor drive time increases, the mixer rotation speed is set to a high value. Since the toner supply amount increases in proportion to the length of the drive time of a toner supply motor 145, the mixer rotation speed is also changed to a high value, so that the chance of contact between the toner and the carrier is increased.

In this embodiment, a mixer rotation speed determination part 101*c* refers to the motor drive time-mixer rotation speed correspondence information stored in the motor drive time-mixer rotation speed storage part 102*b* while using the motor drive time of the toner supply motor 145 counted by the motor drive time counting part 101*e* as a key, and determines the mixer rotation speed of a mixer drive motor 148.

Figure 11:
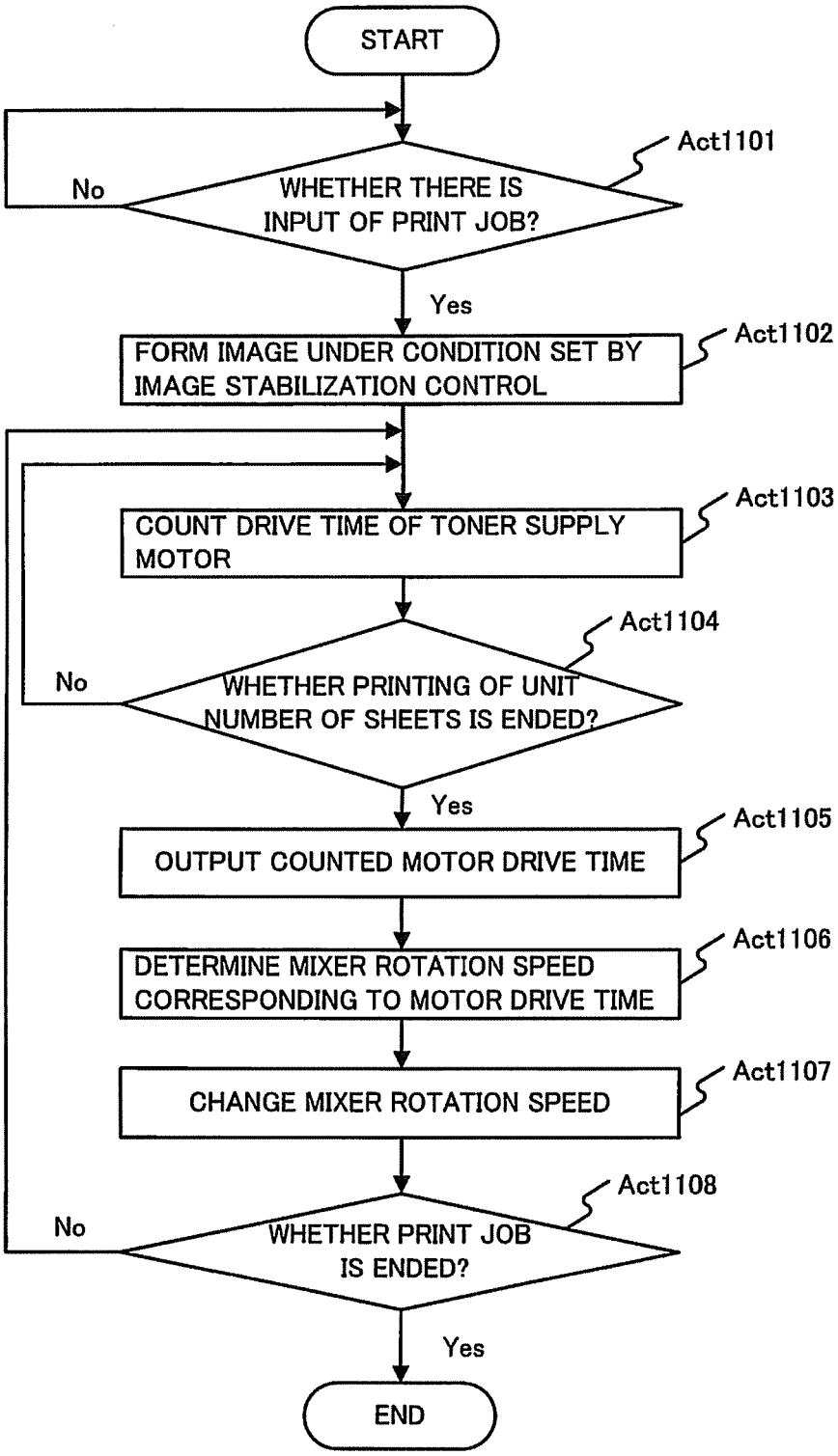
FIG. 11 is a flowchart showing a specific example of a control process of the developing device in the image forming apparatus.

FIG. 11 is a flowchart showing a specific example of a control process of developing devices 14*a* to 14*d* in the image forming apparatus 100.

At Act 1101, an image formation processing part 101*a* determines the presence or absence of input of a print job.

Here, when determination is made that the print job is inputted (Act 1101: Yes), advance is made to Act 1102. When determination is made that the print job is not inputted (Act 1101: No), a standby state occurs.

Act 1102, the image formation processing part 101*a* outputs an image forming condition, which is set in the finally executed image stabilization control and is stored in the memory part 102, to an image forming part 1, and causes the image forming process to be executed.

At Act 1103, the motor drive time counting part 101*e* counts a drive time of the toner supply motor 145 elapsed from the start point of printing of a unit number of sheets, and stores in the memory part 102. Besides, the motor drive time counting part 101*e* counts also the number of printed sheets during execution of the print job, and stores in the memory part 102.

At Act 1104, the motor drive time counting part 101*e* determines whether the number of printed sheets stored in the memory part 102 reaches the unit number of sheets. Here, when determination is made that the printing of the unit number of sheets is ended (Act 1104: Yes), advance is made to Act 1105. When determination is made that printing of the unit number of sheets is not ended (Act 1104: No), return is made to Act 1103.

At Act 1105, the motor drive time counting part 101*e* outputs the counted drive time of the toner supply motor 145 to the mixer rotation speed determination part 101*c*.

At Act 1106, the mixer rotation speed determination part 101*c* refers to the motor drive time-mixer rotation speed correspondence information stored in the motor drive time-mixer rotation speed storage part 102*b* while using the motor drive time counted by the motor drive time counting part 101*e* as a key. When determining the mixer rotation speed of the mixer drive motor 148, the mixer rotation speed determination part outputs a motor drive signal corresponding to the mixer rotation speed to a motor drive controller 105.

At Act 1107, the motor drive controller 105 controls the supply voltage and the like to the mixer drive motor 148 based on the motor drive signal outputted from the mixer rotation speed determination part 101*c*, and the motor rotates at the determined mixer rotation speed.

At Act 1108, the image formation processing part 101*a* determines whether the print job is ended. Here, when determination is made that the print job is ended (Act 1108: yes), the process is ended. When determination is made that the print job is not ended (Act 1108: No), return is made to Act 1103, and the process of Act 1103 to Act 1108 is repeated until the job is ended.

As described above, according to the image forming apparatus 100 of this embodiment, even under the state where the toner adhesion amount per unit pixel increases, the amount of actually supplied toner can be derived from the drive time of the toner supply motor 145. Thus, the mixer rotation speed is changed to a high value according to the increasing tendency of the motor drive time, and the mixer rotation speed is determined based on the actual supply, so that a more stable toner charge amount can be obtained.

Incidentally, in the embodiment, reference is made to the definition information while using the printing ratio or the drive time of the toner supply motor 145 as a key, and the mixer rotation speed is determined. However, a modification can be made such that reference is made to definition information of the combination of these, and the mixer rotation speed is determined. In this case, since a more accurate toner supply amount can be calculated by knowing the printing ratio and the toner supply time, the mixer rotation speed necessary to stabilize the toner charge amount can be more accurately determined. Besides, since a position where development is performed by the developer conveyed by the magnetic sleeve 141 is often separated from a position where toner supply is performed, the toner supply timing is controlled, so that the toner consumed by the development can be accurately supplied to a necessary portion.

Further, the printing ratio-mixer rotation speed correspondence information in the first embodiment and the motor drive time-mixer rotation speed correspondence information in the second embodiment are respectively previously stored in the storage device. However, a structure may be made such that the mixer rotation speed determination part 101*c* calculates the toner supply amount by substituting the printing ratio calculated by the printing ratio calculation part 101*b* or the motor drive time counted by the motor drive time counting part 101*e* into a specified computation expression, and determines the mixer rotation speed. This computation expression is preferably defined such that as the toner supply amount calculated based on the printing ratio or the motor drive time increases, the mixer rotation speed of the mixer drive motor is determined to be a high value.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image forming apparatus, comprising:

a developer containing part to contain a two-component developer including a toner and a carrier;

a developer mixer that is provided in the developer containing part, agitates the two-component developer and charges the toner and the carrier;

a mixer drive motor to drive the developer mixer;

a magnetic sleeve that is provided in the developer containing part and supplies the charged toner to an oppositely arranged photoreceptor;

a sleeve drive motor to drive the magnetic sleeve;

a mixer rotation speed determination part to determine a mixer rotation speed of the mixer drive motor according to a supply amount of the toner supplied to the developer containing part from a toner cartridge by driving of a toner supply motor;

a motor drive controller that independently performs rotation control of the sleeve drive motor and the mixer drive motor, and rotates and controls the mixer drive motor at the mixer rotation speed determined by the mixer rotation speed determination part; and printing ratio calculation part to count the number of pixels per unit number of printed sheets and to calculate a printing ratio, wherein the mixer rotation speed determination part calculates the supply amount of the toner according to the printing ratio calculated by the printing ratio calculation part, and determines the mixer rotation speed of the mixer drive motor.

2. The apparatus of claim 1, wherein the mixer rotation speed determination part determines the mixer rotation speed of the mixer drive motor to be a high value according to an increasing tendency of the supply amount of the toner calculated based on the printing ratio.

3. The apparatus of claim 1, further comprising a printing ratio-mixer rotation speed storage part to store printing ratio-mixer rotation speed correspondence information in which the mixer rotation speed is previously defined to be a high value according to an increasing tendency of the printing ratio, wherein the mixer rotation speed determination part refers to the printing ratio-mixer rotation speed correspondence information while using the printing ratio calculated by the printing ratio calculation part as a key, and determines the mixer rotation speed of the mixer drive motor.

4. An image forming apparatus, comprising:

a developer containing part containing a two-component developer including a toner and a carrier;

a developer mixer that is provided in the developer containing part, agitates the two-component developer and charges the toner and the carrier;

a mixer drive motor to drive the developer mixer;

a magnetic sleeve that is provided in the developer containing part and supplies the charged toner to an oppositely arranged photoreceptor;

a sleeve drive motor to drive the magnetic sleeve;

a mixer rotation speed determination part to determine a mixer rotation speed of the mixer drive motor according to a supply amount of the toner supplied to the developer containing part from a toner cartridge by driving of a toner supply motor;

a motor drive controller that independently performs rotation control of the sleeve drive motor and the mixer drive motor, and rotates and controls the mixer drive motor at the mixer rotation speed determined by the mixer rotation speed determination part; and a motor drive time counting part to count a toner supply motor drive time per unit number of printed sheets, wherein the mixer rotation speed determination part calculates the supply amount of the toner according to the toner supply motor drive time counted by the motor drive time counting part, and determines the mixer rotation speed of the mixer drive motor.

5. The apparatus of claim 4, wherein the mixer rotation speed determination part determines the mixer rotation speed of the mixer drive motor to be a high value according to an increasing tendency of the supply amount of the toner calculated based on the toner supply motor drive time.

6. The apparatus of claim 4, further comprising a motor drive time-mixer rotation speed storage part to store motor drive time-mixer rotation speed correspondence information in which the mixer rotation speed is previously defined to be a high value according to an increase of the toner supply motor drive time, wherein the mixer rotation speed determination part refers to the motor drive time-mixer rotation speed correspondence information while using the toner supply motor drive time counted by the motor drive time counting part as a key, and determines the mixer rotation speed of the mixer drive motor.

7. An image forming apparatus, comprising:

a developer containing part containing a two-component developer including a toner and a carrier;

a developer mixer that is provided in the developer containing part, agitates the two-component developer and charges the toner and the carrier;

a mixer drive motor to drive the developer mixer;

a magnetic sleeve that is provided in the developer containing part and supplies the charged toner to an oppositely arranged photoreceptor;

a sleeve drive motor to drive the magnetic sleeve;

a mixer rotation speed determination part to determine a mixer rotation speed of the mixer drive motor according to a supply amount of the toner supplied to the developer containing part from a toner cartridge by driving of a toner supply motor;

a motor drive controller that independently performs rotation control of the sleeve drive motor and the mixer drive motor, and rotates and controls the mixer drive motor at the mixer rotation speed determined by the mixer rotation speed determination part;

a printing ratio calculation part to count the number of pixels per unit number of printed sheets and to calculate a printing ratio; and a motor drive time counting part to count a toner supply motor drive time per unit number of printed sheets, wherein the mixer rotation speed determination part calculates the toner amount based on the printing ratio calculated by the printing ratio calculation part and the toner supply motor drive time counted by the motor drive time counting part, and determines the mixer rotation speed of the mixer drive motor.

8. The apparatus of claim 7, wherein the mixer rotation speed determination part determines the mixer rotation speed of the mixer drive motor to be a high value according to an increasing tendency of the supply amount of the toner calculated based on the toner supply motor drive time.

9. The apparatus of claim 8, further comprising:

a printing ratio-mixer rotation speed storage part to store printing ratio-mixer rotation speed correspondence information in which the mixer rotation speed is previously defined to be a high value according to an increasing tendency of the printing ratio; and a motor drive time-mixer rotation speed storage part to store motor drive time-mixer rotation speed correspondence information in which the mixer rotation speed is previously defined to be a high value according to an increasing tendency of the toner supply motor drive time, wherein the mixer rotation speed determination part refers to the printing ratio-mixer rotation speed correspondence information while using the printing ratio calculated by the printing ratio calculation part as a key, and refers to the motor drive time-mixer rotation speed correspondence information while using the toner supply motor drive time counted by the motor drive time counting part as a key, and determines a new mixer rotation speed based on the respective acquired mixer rotation speeds of the mixer drive motor.

10. A toner charge amount adjustment method of an image forming apparatus, comprising:

supplying a toner to a developer containing part of a developing device from a toner cartridge during execution of a print job;

determining a mixer rotation speed of a mixer drive motor to drive a developer mixer, which agitates and charges a two-component developer including the toner and a carrier in the developer containing part, according to a supply amount of the toner supplied from the toner cartridge to the developer containing part;

independently performing rotation control of a sleeve drive motor for driving a magnetic sleeve to supply the charged toner to an oppositely arranged photoreceptor and rotation control of the mixer drive motor;

performing the rotation control of the mixer drive motor based on the determined mixer rotation speed;

counting the number of pixels per unit number of printed sheets to calculate a printing ratio;

calculating the supply amount of the toner according to the calculated printing ratio; and determining the mixer rotation speed of the mixer drive motor.

11. The method of claim 10, wherein the mixer rotation speed of the mixer drive motor is determined to be a high value according to an increasing tendency of the supply amount of the toner calculated based on the printing ratio.

12. The method of claim 10, further comprising:

storing, in a storage device of the image forming apparatus, printing ratio-mixer rotation speed correspondence information in which the mixer rotation speed is previously defined to be a high value according to an increasing tendency of the printing ratio;

referring to the printing ratio-mixer rotation speed correspondence information while using the calculated printing ratio as a key; and determining the mixer rotation speed of the mixer drive motor.

13. A toner charge amount adjustment method of an image forming apparatus, comprising:

supplying a toner to a developer containing part of a developing device from a toner cartridge during execution of a print job;

determining a mixer rotation speed of a mixer drive motor to drive a developer mixer, which agitates and charges a two-component developer including the toner and a carrier in the developer containing part, according to a supply amount of the toner supplied from the toner cartridge to the developer containing part;

independently performing rotation control of a sleeve drive motor for driving a magnetic sleeve to supply the charged toner to an oppositely arranged photoreceptor and rotation control of the mixer drive motor;

performing the rotation control of the mixer drive motor based on the determined mixer rotation speed;

counting a toner supply motor drive time per unit number of printed sheets;

calculating the supply amount of the toner according to the counted toner supply motor drive time; and determining the mixer rotation speed of the mixer drive motor.

14. The method of claim 13, wherein the mixer rotation speed of the mixer drive motor is determined to be a high value according to an increasing tendency of the supply amount of the toner calculated based on the toner supply motor drive time.

15. The method of claim 13, further comprising:

storing, in a storage device of the image forming apparatus, motor drive time-mixer rotation speed correspondence information in which the mixer rotation speed is previously defined to be a high value according to an increase of the toner supply motor drive time;

referring to the motor drive time-mixer rotation speed correspondence information while using the counted toner supply motor drive time as a key; and determining the mixer rotation speed of the mixer drive motor.

16. A toner charge amount adjustment method of an image forming apparatus, comprising:

supplying a toner to a developer containing part of a developing device from a toner cartridge during execution of a print job;

determining a mixer rotation speed of a mixer drive motor to drive a developer mixer, which agitates and charges a two-component developer including the toner and a carrier in the developer containing part, according to a supply amount of the toner supplied from the toner cartridge to the developer containing part;

independently performing rotation control of a sleeve drive motor for driving a magnetic sleeve to supply the charged toner to an oppositely arranged photoreceptor and rotation control of the mixer drive motor;

performing the rotation control of the mixer drive motor based on the determined mixer rotation speed counting the number of pixels per unit number of printed sheets to calculate a printing ratio;

counting a toner supply motor drive time per unit number of printed sheets;

calculating the toner amount based on the calculated printing ratio and the counted toner supply motor drive time; and determining the mixer rotation speed of the mixer drive motor.

17. The method of claim 16, wherein the mixer rotation speed of the mixer drive motor is determined to be a high value according to an increasing tendency of the supply amount of the toner calculated based on the toner supply motor drive time.

18. The apparatus of claim 17, further comprising:

storing, in a storage device of the image forming apparatus, printing ratio-mixer rotation speed correspondence information in which the mixer rotation speed is previously defined to be a high value according to an increasing tendency of the printing ratio, and motor drive time-mixer rotation speed correspondence information in which the mixer rotation speed is previously defined to be a high value according to an increasing tendency of the toner supply motor drive time;

referring to the printing ratio-mixer rotation speed correspondence information while using the calculated printing ratio as a key;

referring to the motor drive time-mixer rotation speed correspondence information while using the counted toner supply motor drive time as a key; and determining a new mixer rotation speed based on the respective acquired mixer rotation speeds of the mixer drive motor.

* * * * *